US005341889A

United States Patent [19]

Narvestad

[11] Patent Number: 5,341,889

[45] Date of Patent: Aug. 30, 1994

[54] RING CLAMP FOR A CUTTER RING IN A TUNNEL DRILLING MACHINE

[75] Inventor: Stein Narvestad, Oslo, Norway

[73] Assignee: Stein Narvestad A.S., Oslo, Norway

[21] Appl. No.: 940,880

[22] PCT Filed: Apr. 5, 1991

[86] PCT No.: PCT/NO91/00055

§ 371 Date: Oct. 21, 1992

§ 102(e) Date: Oct. 21, 1992

[87] PCT Pub. No.: WO91/15653

PCT Pub. Date: Oct. 17, 1991

[51] Int. Cl.[5] ..... E21B 10/12; E21C 25/18

[52] U.S. Cl. ..... 175/373; 175/351

[58] Field of Search ..... 175/351, 373, 374, 375; 299/86, 93

[56] References Cited

U.S. PATENT DOCUMENTS

| | | | |
|---|---|---|---|
| 3,981,370 | 9/1976 | Bingham et al. | 175/373 |
| 3,982,594 | 9/1976 | Ott | 175/373 |
| 4,004,645 | 1/1977 | Rees et al. | 175/373 |

*Primary Examiner*—David J. Bagnell

*Attorney, Agent, or Firm*—Kane, Dalsimer, Sullivan, Kurucz, Levy Eisele and Richard

[57] ABSTRACT

A cutter for a tunnel boring machine with cutter ring in two or more ring segments with a dovetail base, clamped to the cutter hub by a segmented clamping ring. The ring segments have a wedge shaped cross section, and are mounted in a groove. The segments are fastened to the hub by bolts. To facilitate loosening of the ring segments, the segments have a curvature different from that of the groove, so that an elastic force will be accumulated in the ring segments when they are mounted and the bolts are tightened. The curvature of the ring segments is either smaller or greater than that of the groove.

7 Claims, 2 Drawing Sheets

RING CLAMP FOR A CUTTER RING IN A TUNNEL DRILLING MACHINE

FIELD OF THE INVENTION

The present invention is related to a ring clamp for securing a cutter ring to a cutter roll on a tunnel boring machine (a/k/a T.B.M.).

BACKGROUND OF THE INVENTION

Several developments have been suggested to reduce the amount of labor in connection with replacing cutter rings on cutters for tunnel drilling machines. This work is time consuming and the T.B.M. as such is out of operation for long periods of time which to a large extent may influence the progress and also the costs.

One solution to this problem has been achieved with a divided cutter ring and especially with a wedge shaped ring clamp securing the divided cutter ring such as described in NO-PA 883 533. Although the replacement operation has been facilitated substantially, loosening of the ring clamp still may be time consuming when replacing the cutter ring segments, as the ring clamp has a tendency to jam due to the large force used when tightening the bolts.

SUMMARY OF THE INVENTION

It therefore is the aim of the present invention to provide a ring clamp for cutter rings divided into segments, which easily may be released after having been clamped. This is achieved with the ring clamp according to the present invention.

DESCRIPTION OF THE PREFERRED EMBODIMENT

Figure 1:
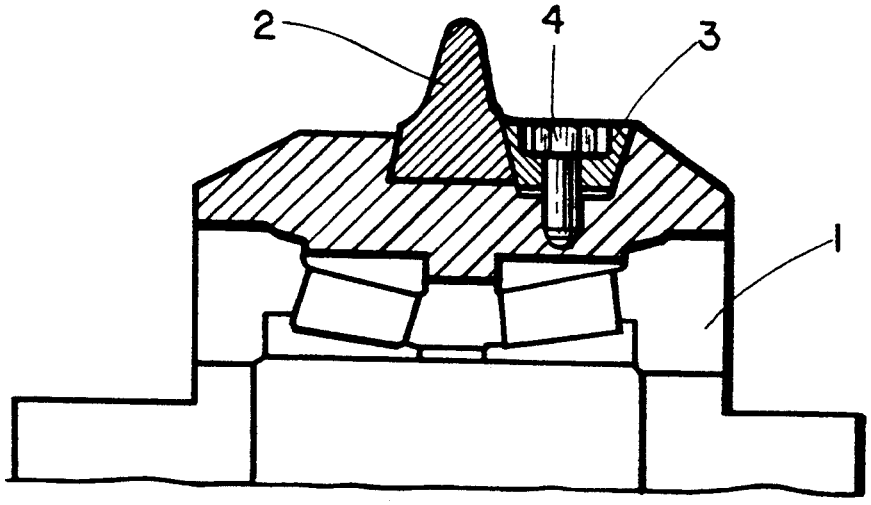
FIG. 1 is a side elevational view of the cutter ring assembly showing the ring clamp of the preferred embodiment.

A well-known cutter i is provided with a cutter ring 2 with a dovetail shaped base and being divided in a number of segments which are clamped with a wedge-formed ring clamp 3.

The ring clamp is divided in segments 3A, 3B and 3C. The segments of the clamp are secured to the cutter 1 with bolts 4, whereby each bolt 4 clamps two clamp ring segments simultaneously by arranging the bolts between the segments.

Figure 2:
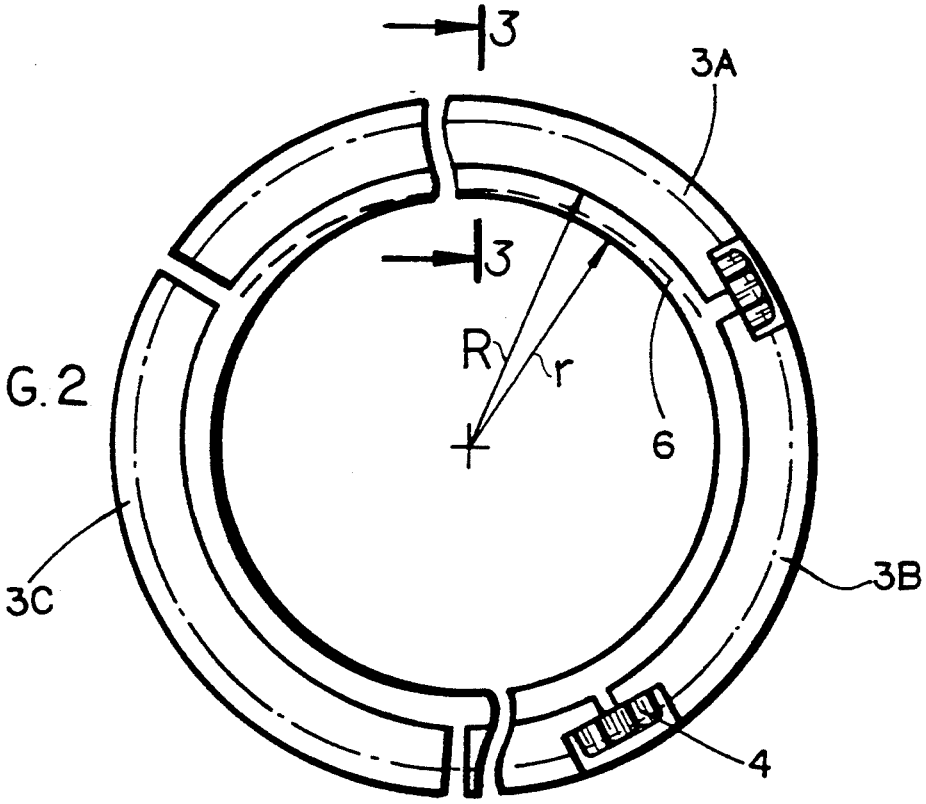
FIG. 2 is a top plan view of the preferred embodiment.

The ring clamp may comprise three segments 3A, 3B, and 3C as disclosed in FIG. 2. In a modification of the present invention each of the ring clamp segments is secured with two or more bolts, the ring clamp thereby comprising two segments. The ring clamp, however, may comprise more than three segments.

In connection with known types of divided ring clamps it is known that the cutter ring 2 is very well secured to the cutter but that the dismantling and securement takes a relatively long time. The dismantling is especially time consuming. The reason is that cutters today work with an average load of up to 35,000 kp, with shock loads up to 100,000 kp. For this reason the segments must be very strongly secured. During operation the cutter ring 2 and the ring clamp 3 become heated which increases the jamming of the ring clamp segments and make dismantling extremely difficult.

Figure 3:
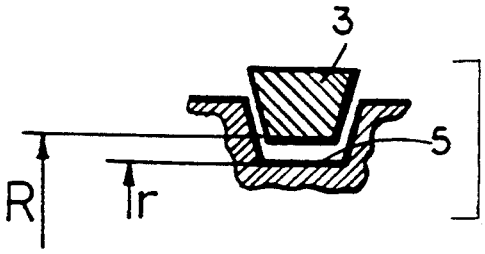
FIG. 3 is a side elevational view of the preferred embodiment along line III—III of FIG. 2.

All known designs of this kind of ring clamp are based on a ring clamp having the same curvature as the groove in which this is secured. The present invention eliminates the problems connected with prior art designs by manufacturing a ring clamp 3 having a somewhat larger or smaller curvature than the groove 5 in which it is to be secured, which is disclosed in FIGS. 2 and 3.

Figure 4:
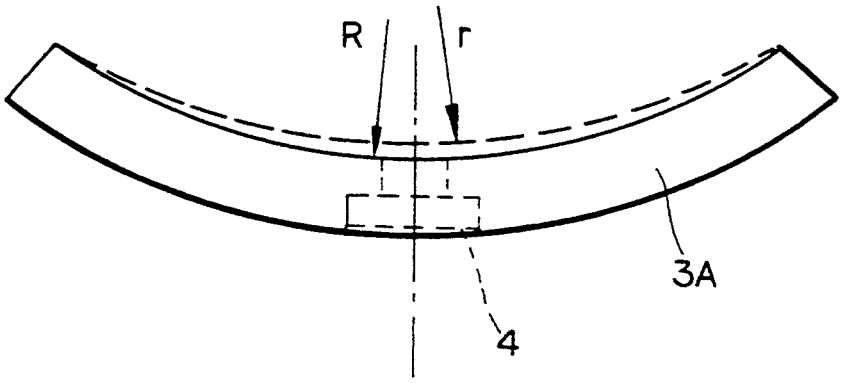
FIG. 4 is a top plan view of the alternative to the preferred embodiment.

In relation to the radius r of the groove 5, the ring clamp is manufactured with a different curvature R. Arranged in the groove, the clamp segments may have a position corresponding to the dotted line 6 in FIG. 2. Here segments with an inner segment radius R larger than the groove radius r are forced into the groove. The practical effect of the difference in segment radius R and groove radius r is that the curvature of segment radius R is different from the curvature of groove radius r. When the bolts 4 are inserted and tightened, the ends of the segments are pressed into the groove. This effects a biasing of the ring clamp 3 by elastic deformation of the clamp, forced to assume the curvature of the groove. FIG. 4 shows a segment having n inner segment radius R smaller than the groove radius r, resulting in the same effect.

Principally a similar effect may be achieved with ring clamps having a segment curvature R smaller than the groove radius r, however, with a different bolt arrangement, such as one or two bolts in the middle of each segment.

When loosening the bolts 4, the biasing of the ring clamp will press the segments back to the initially unloaded shape and the ends of the segments 3, 3B and 3C thereby are lifted out of the groove 5, making it easy to remove the segments.

To ensure that the segments easily can be released, portions of the segments may be covered with a material having low friction, such as Teflon® a/k/a polytetrafloroethylene, thereby insuring minimum friction forces between the segments and the groove and between the segments and the bolts.

I claim:

1. A ring clamp for securing a cutter ring to a cutter ring in a tunnel boring machine, the cutter ring comprising at least two segments having a dovetail shaped base and a ring clamp having a corresponding wedge shape comprising at least two segments whereby the segments are secured to the roll by means of bolts, wherein the curvature of the segments is different from the curvature of a groove in which the segments of the ring clamp are secured.

2. The ring clamp according to claim 1, wherein the segments are adapted for securement by means of one bolt at each end of the segment such that each bolt clamps the ends of adjacent segments.

3. The ring clamp according to claim 1, wherein the segments being adapted for securement by means of at least two bolts.

4. The ring clamp according to claim 1, wherein the curvature of the segments is larger than the curvature of the groove.

5. The ring clamp according to claim 1 wherein the curvature of the segments being smaller than the curvature of the groove.

6. A ring clamp for securing a cutter ring to a cutter roll in a tunnel boring machine, the cutter ring comprising at least two segments having a dovetail shaped base and a ring clamp having a corresponding wedge shape comprising at least two segments whereby the segments are secured to the roll by means of bolts, wherein the curvature of the segments is greater than the curvature of a groove in which the segments of the ring clamp are secured, and wherein the segments are adapted for securement by means of one bolt at each end of the segment such that each bolt clamps the ends of adjacent segments.

7. A ring clamp for securing a cutter ring to a cutter roll in a tunnel boring machine, the cutter ring comprising at least two segments having a dovetail shaped base and a ring clamp having a corresponding wedge shape comprising at least two segments whereby the segments are secured to the roll by means of bolts, wherein the curvature of the segments is different from the curvature of a groove in which the segments of the ring clamp are secured, and wherein the curvature of the segments is smaller than the curvature of the groove.

* * * * *